US010662559B2

(12) United States Patent
Karatzis

(10) Patent No.: US 10,662,559 B2
(45) Date of Patent: May 26, 2020

(54) RASCHEL MACHINE, NET, AND USE OF THE RASCHEL MACHINE TO PRODUCE A NET

(71) Applicant: Karatzis S.A. Industrial & Hotelier Enterprises, Heraklion (GR)

(72) Inventor: Antonios Karatzis, Heraklion (GR)

(73) Assignee: Karatzis S.A. Industrial & Hotelier Enterprises, Heraklion, GA (US)

( * ) Notice: Subject to any disclaimer, the term of this patent is extended or adjusted under 35 U.S.C. 154(b) by 55 days.

(21) Appl. No.: 15/776,624

(22) PCT Filed: Oct. 13, 2016

(86) PCT No.: PCT/EP2016/074610
§ 371 (c)(1),
(2) Date: May 16, 2018

(87) PCT Pub. No.: WO2017/084814
PCT Pub. Date: May 26, 2017

(65) Prior Publication Data

US 2018/0340277 A1 Nov. 29, 2018

(30) Foreign Application Priority Data

Nov. 17, 2015 (DE) ..... 10 2015 119 867

(51) Int. Cl.
*D04B 21/12* (2006.01)
*D04B 27/24* (2006.01)

(52) U.S. Cl.
CPC ..... *D04B 21/12* (2013.01); *D04B 27/24* (2013.01); *D10B 2505/10* (2013.01)

(58) Field of Classification Search
CPC ..... D04B 27/24; D04B 21/12; D04B 21/10
See application file for complete search history.

(56) References Cited

U.S. PATENT DOCUMENTS 3,251,201 A 5/1966 Newman
4,671,988 A * 6/1987 Dowell ..... F41H 3/00 2/900

(Continued)

FOREIGN PATENT DOCUMENTS

DE 6936578 U 1/1970
DE 9306474 U1 6/1993

(Continued)

OTHER PUBLICATIONS

"RS2-4NFISOET N Raschel Machine", Warp Knitting Fascicle of the Knitting Engineering Manual Second Edition, Editorial Board of China Textile Press, Mar. 31, 2011, pp. 166-167. English language translation of the CN action which discusses the CN reference is provided.

(Continued)

*Primary Examiner* — Danny Worrell
(74) *Attorney, Agent, or Firm* — Murphy, Bilak & Homiller, PLLC

(57) ABSTRACT

A Raschel machine (100) comprises a plurality of first guide needles (110) arranged along a first direction for guiding warp threads (210), a plurality of second guide needles (150) arranged along the first direction for guiding weft threads (220) and a plurality of needles (180) arranged along the first direction for creating interlocked loops formed by threads, whereby the warp threads (210) are created. The first guide needles (110) are held by a first needle bar (120), the second guide needles (150) are held by a second needle bar (160), and the second needle bar (160) is moved back and forth between two respective neighbouring first guide needles (110). The space between neighbouring first guide needles (110) is greater than 25.4 m (1 inch).

10 Claims, 7 Drawing Sheets

(56) References Cited

U.S. PATENT DOCUMENTS

| | | | | |
|---|---|---|---|---|
| 5,104,714 | A * | 4/1992 | Leiber | D01D 5/426 206/442 |
| 5,544,500 | A | 8/1996 | Speich | |
| 5,660,062 | A * | 8/1997 | Diestel | D04B 21/10 66/214 |
| 6,141,993 | A * | 11/2000 | Whitbeck | D04B 21/10 66/195 |
| 6,399,523 | B1 * | 6/2002 | Matsumoto | C09K 17/52 442/1 |
| 6,521,551 | B1 * | 2/2003 | Mass | D04B 21/12 442/1 |
| 2001/0013233 | A1 * | 8/2001 | Motoya | D04B 21/10 66/85 R |
| 2002/0157429 | A1 * | 10/2002 | Matsumoto | D04B 21/10 66/195 |
| 2005/0120755 | A1 * | 6/2005 | Dort | D04B 21/12 66/195 |
| 2007/0234762 | A1 * | 10/2007 | Willner | B65H 18/00 66/151 |
| 2008/0053158 | A1 * | 3/2008 | Willner | D04B 21/10 66/193 |
| 2008/0134726 | A1 * | 6/2008 | Lais | D04B 21/10 66/170 |
| 2010/0266831 | A1 * | 10/2010 | Durie | B29C 70/885 428/221 |
| 2014/0060119 | A1 * | 3/2014 | Karatzis | D04B 21/10 66/193 |
| 2016/0053417 | A1 * | 2/2016 | Tanaka | D04B 21/12 66/195 |
| 2018/0333939 | A1 * | 11/2018 | Karatzis | B65D 65/40 |

FOREIGN PATENT DOCUMENTS

| | | | |
|---|---|---|---|
| DE | 19638392 | A1 | 4/1997 |
| DE | 69817510 | T2 | 6/2004 |
| DE | 102005006110 | A1 | 8/2006 |
| EP | 1736583 | A1 | 12/2006 |
| GB | 2124975 | A | 2/1984 |
| JP | 2015151635 | A | 8/2015 |
| KR | 20120031850 | A | 4/2012 |
| NZ | 600851 | A | 4/2014 |
| SU | 137216 | A1 | 11/1960 |
| WO | 2012119624 | A1 | 9/2012 |
| WO | 2012160403 | A1 | 11/2012 |

OTHER PUBLICATIONS

"Shade Net Production", Accessed online Dec. 9, 2109 at https://www.youtube.com/watch?v=ChsL7kxAD4U.

Spencer, David J., "Description of the raschel machine", Chapter 24.3.2, Knitting Technology, Third Edition, 2001, pp. 302-303.

* cited by examiner

RASCHEL MACHINE, NET, AND USE OF THE RASCHEL MACHINE TO PRODUCE A NET

BACKGROUND

The present invention relates to a Raschel machine, a net and the use of the Raschel machine for producing a net.

Nets are commonly used as a material or non-airtight packing of loose goods as e.g. hay, straw, vegetables, raw cotton or other plant parts. Nets can be produced by, e.g., Raschel machines. Such Raschel machines are for example manufactured by Textilmaschinenfabrik Karl Mayer GmbH, Frankfurt, Germany.

SUMMARY

The present invention has the object to provide an enhanced Raschel machine and a net as well as an improved method for producing a net.

According to the present invention the object is achieved by the subject matter and the method of the independent claims. Preferred further developments are described in the dependent claims.

Those skilled in the art will recognize additional features and advantages upon reading the following detailed description and viewing the accompanying drawings.

BRIEF DESCRIPTION OF THE DRAWINGS

The accompanying drawings are included to provide a deeper understanding of embodiments, are incorporated in and constitute a part of this application. The drawings illustrate the main embodiments and serve, together with the description, to explain the principles of the invention. Other embodiments and numerous intended advantages will readily be appreciated upon reasonable reading of the following detailed description. The elements of the drawings are not necessarily scaled to each other. Same reference signs refer to correspondingly similar parts.

DETAILED DESCRIPTION

In the following detailed description, reference is made to the accompanying drawings, which constitute a part of the detailed description and in which, by way of illustrations, specific embodiments are shown in which the invention may be practiced. In this regard, a directional terminology such as "top", "bottom", "front", "back", "leading", "trailing" etc. is used as for the orientation of the figures being described in this context. As the components of embodiments of the invention may be positioned in a variety of different orientations, the directional terminology is used for illustrative purposes and is in no way limiting. It is to be understood that other embodiments can be utilized and structural or logical changes can be made without departing from the scope defined by the claims.

The description of the embodiments is not limiting. Particularly, elements of the individual embodiments described hereinafter may be combined with elements of different embodiments.

For further explanation of components of the Raschel machine and the produced net, respectively, the terms mentioned below are used in the following:

Hereinafter, for further explanation the terms below are used:

Net or rather Fabric: thin bands, for example made from or consisting of synthetics, e.g. polyolefins as for example LLPDE (linear polyethylene with low density), LDPE (polyethylene with low density), HDPE (polyethylene with high density), PVC (polyvinyl chloride), EVA (ethylene vinyl acetate), or a similar synthetic, are processed to a net or rather a fabric.

Threads: the thin bands the net is made of.

Warp Threads: The loops interlocked to a loop compound in flow direction of the net.

Wefts: The threads with a zigzag interweaving connecting the warp threads to a net.

MD (Machine Direction): the flow direction of the net during the production or unrolling.

TD (Transversal Direction): The direction perpendicular to the flow direction or machine direction.

Figure 1:
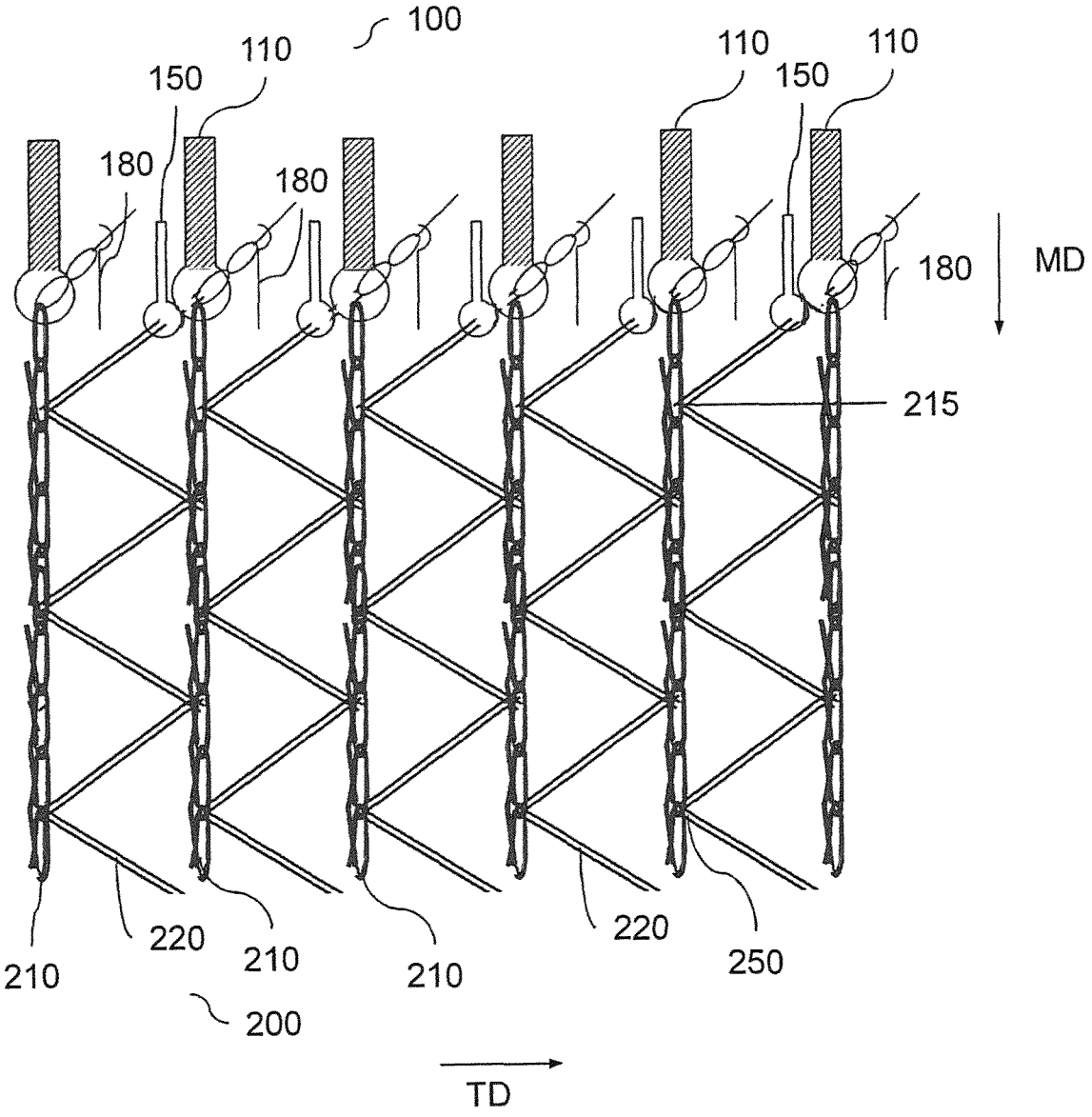
FIG. 1 shows an example of a Raschel machine with a produced net.

FIG. 1 shows a schematic illustration of components of a Raschel machine 100 as well as a net 200 produced by the Raschel machine. In this regard it is noted that usually a Raschel machine comprises a plurality of further components omitted due to illustrative reasons. In the following, in particular those components are described which are considered to be important for understanding the teaching according to the invention.

The Raschel machine 100 comprises a plurality of first guide needles 110 for guiding warp threads 210. The first guide needles 110 are arranged along a first direction. For example, the first direction corresponds to the transversal direction TD and is orthogonal to the flow direction of the net. The number of guide needles corresponds to the number of warp threads 210 to be created. The Raschel machine further comprises a plurality of second guide needles 150 arranged along the first direction for guiding the weft threads 220. Furthermore, the Raschel machine comprises a plurality of needles 180 arranged along the first direction for creating interlocked loops formed by threads, whereby the warp threads 210 are created.

Figure 2A:
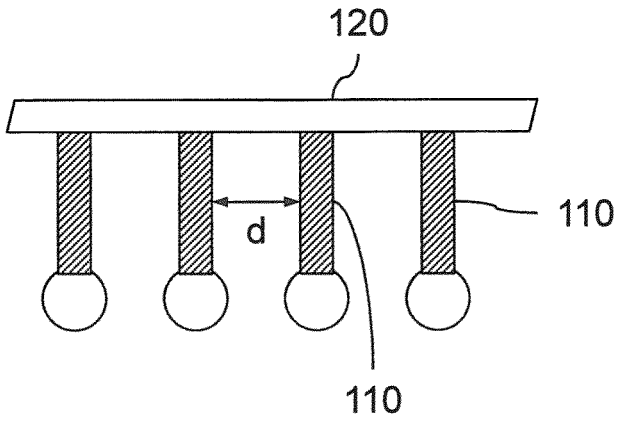
FIG. 2A shows an example of a first needle bar with first guide needles.
Figure 2B:
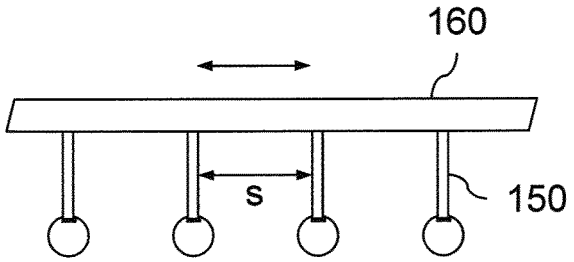
FIG. 2B shows an example of a second needle bar with second guide needles.

As shown in FIG. 2A, the first guide needles 110 are held by a first needle bar 120. The second guide needles 150 are held by a second needle bar 160. The second needle bar 160 is moved back and forth between two respective neighbouring first needle bars. The space between neighbouring first guide needles 110 is greater than 25.4 mm (1 inch). Commonly, the needles 180 are arranged on a metal base (sheets) (not shown) performing a back and forth movement of the needles 180 upwards and downwards. In this way, the threads are looped to interlocked loops and warp threads are created.

The first needle bar 120 with the first guide needles 110 attached therein may be configured as a metal base performing a circular motion. The position of the first guide needles 110 is fixed along the transversal direction. The second needle bar 160 the second guide needles 150 for guiding the weft threads are attached to moves back and forth along the transversal direction between two respective neighbouring first guide needles such that upon a movement of the warp threads in the machine direction a zigzag pattern is formed. For example, a weft thread is guided between two neighbouring warp threads 210 such that it connects those with each other. Thus a connection technique without any knots is enabled. The weft thread is respectively guided through the warp thread 210 at the connection points.

The second needle bar 160 the second guide needles 150 for guiding the weft threads are attached to periodically moves back and forth along the transversal direction by the space d between neighbouring first guide needles, respectively. According to an embodiment, now a space d, shown for example in FIG. 2A, between neighbouring first guide needles 110 being greater than 25.4 mm is provided. For instance, the space d between neighbouring guide needles 110 may be greater than 28 mm, in particular greater than 30 mm. The space d may be 30.48 mm (1.2 inch), for example. According to a further embodiment the space d may be even greater, e.g. 38.1 mm (1.5 inch), or greater than 40 mm, in particular greater than 45 mm, e.g. 50.8 mm (2 inch). The space may be smaller than 101.6 mm (4 inch), for example.

By using the Raschel machine according to the invention, now a net with a greater space of neighbouring warp threads can be produced. Accordingly, the number of warp threads is reduced with constant width. For example, as for a conventional net 52 warp threads are required to produce a net with a standard width of 123 cm, now nets with the standard width of 123 cm can be produced with considerably less warp threads. As an advantage a lower final weight of the produced net with equal strength of the used threads can be achieved. Conversely, thicker threads than usual can be used thereby facilitating the production. The strength of the used threads can be set such that the same final weight as with the conventional machine can be achieved with a reduced number of warp threads. Due to the fact that thicker threads are used, the breakage risk of the threads during the production is reduced. Accordingly, it is no longer necessary to interrupt the production due to thread breakage. As a result the throughput can be increased and the production costs can be lowered.

In dimensioning a suitable space between neighbouring guide needles 110 it has to be considered that according to the increased space the second needle bar 160 has to move laterally over an also increased distance. With constant frequency an increased distance of lateral movement may result in an excessive load on the driving motor for the second needle bar. Accordingly, the frequency can be reduced in order to avoid an overload on the motor with an increased distance of lateral movement. However, a reduction of the frequency causes a slower production of the net and thus results in a decrease of the efficiency of the Raschel machine. It was noted that an optimal throughput can be achieved with a space d of neighbouring guide needles 110 of 50.8 mm (2 inch). For example, the frequency can be halved compared to a Raschel machine with a 25.4 mm (1 inch) space of the guide needles 110. The benefits related to the increased space of the warp threads of the finished net counterbalance the disadvantages caused by halving the frequency. On the contrary, with a greater space the efficiency of the Raschel machine is impaired due to the still reduced frequency. Due to the space increased in comparison to 25.4 mm, with a smaller space the weight reduction may be too small in order to counterbalance the disadvantages caused by adapting the frequency.

The space s between neighbouring second guide needles 150 at the second needle bar may correspond to the space d between neighbouring first guide needles 110. Furthermore, the space between neighbouring needles 180 may correspond to the space d.

Figure 3:
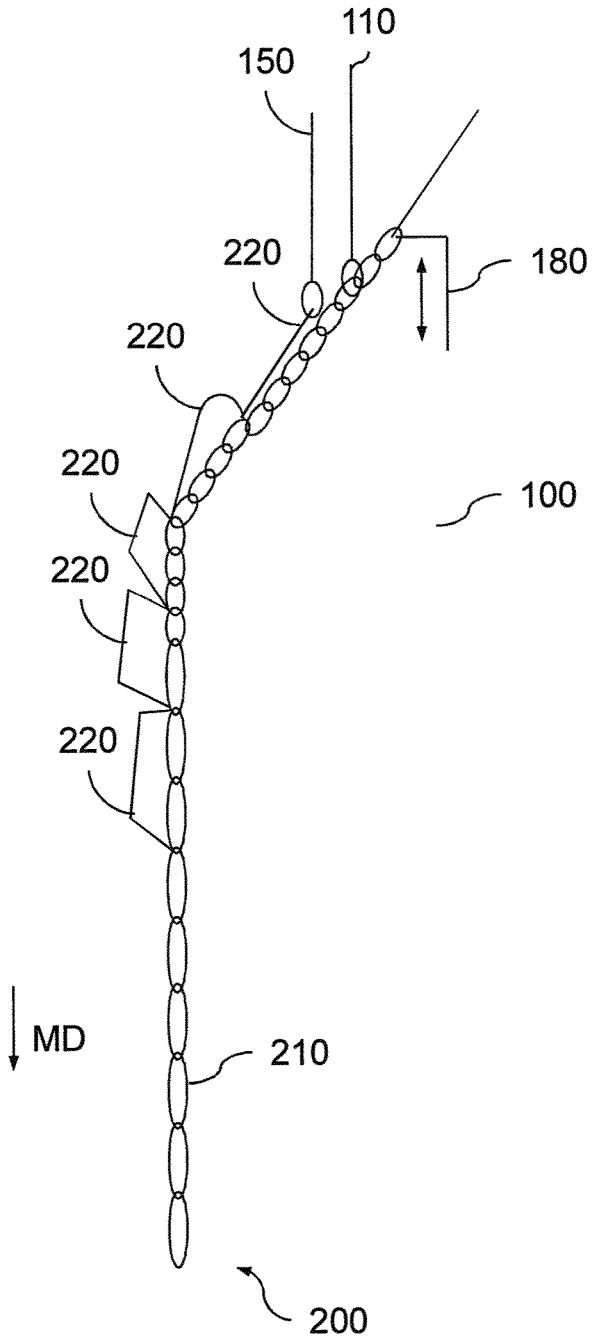
FIG. 3 shows a side view of a Raschel machine.

FIG. 3 shows a side view of the Raschel machine 100 with the produced net 200. In particular, here a side view of a single first guide needle 110 and a single second guide needle 150 is shown. As can be seen, the needle 180 for creating the interlocked loops is arranged such that is can perform an up-and-down movement. The first guide needle 110 guides the created warp thread, whereas the second guide needle 150 guides the weft thread and moves back and forth between two neighbouring first guide needles.

Thus, as also shown in FIG. 1, firstly the warp thread 210 is created and then the weft thread 220 is guided through. The produced net 200 flows in machine direction.

Figure 4:
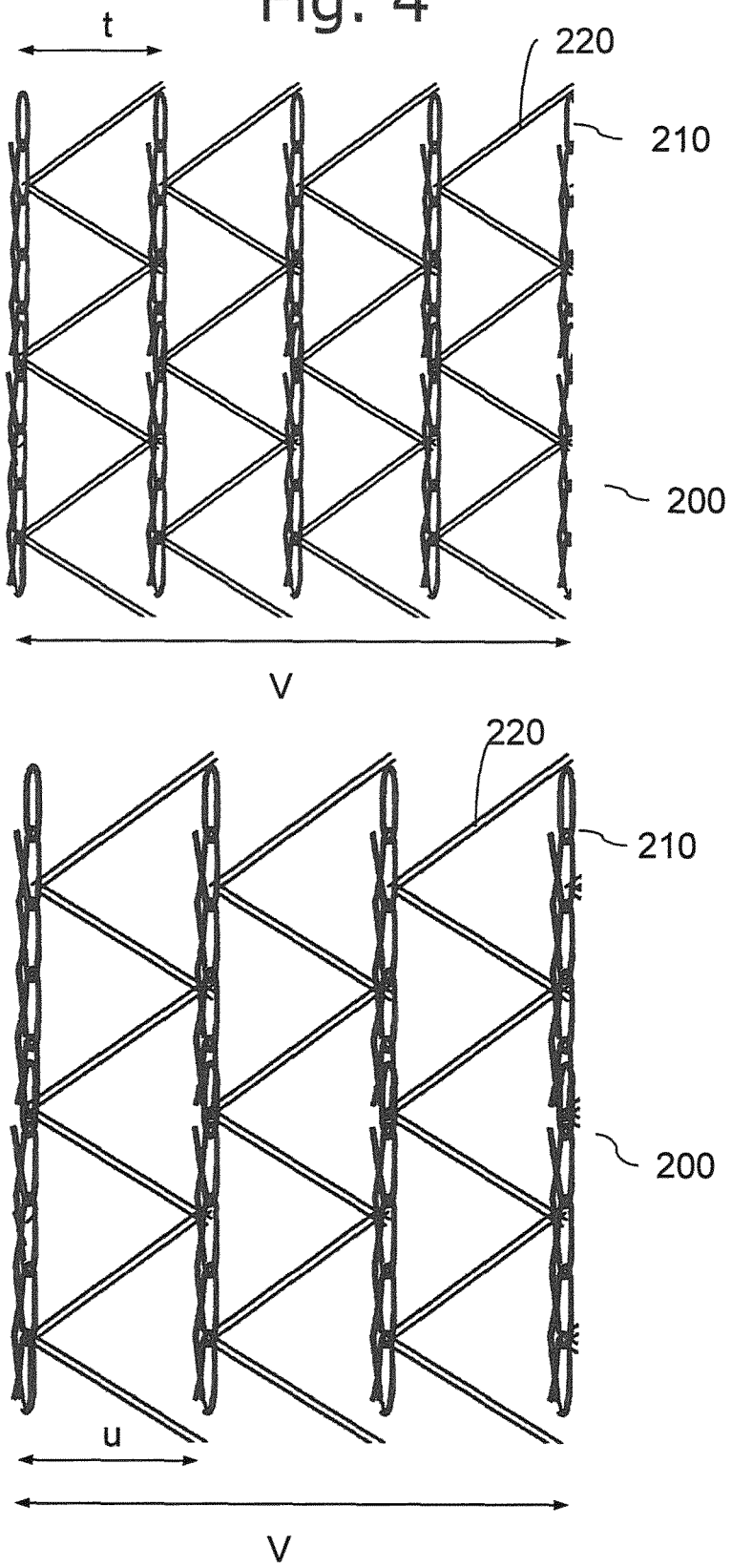
FIG. 4 illustrates a net according to an embodiment.

FIG. 4 shows a comparison between two produced nets 200. Usually, Raschel machines are dimensioned such that they enable a production of a net with predefined width. Standard widths produced by a Raschel machine are 123 cm, for example. Commonly, the first guide needles 110 are arranged with a space of 25.4 mm or less. This results in the net 200 shown in the upper part of FIG. 4 which has a total width v (e.g. 123 cm) and a space t between neighbouring warp threads 210 of 25.4 mm.

By using the Raschel machine according to the invention, now a net 200 with a greater space u of neighbouring warp threads 210 can be produced. Correspondingly, the number of warp threads 210 is reduced with constant width. If for a conventional net, for example, 52 warp threads are required to produce a net with a standard width of 123 cm, now nets with the standard width of 123 cm can be produced with less warp threads 210. For example, with a space u of neighbouring warp threads 210 of 30.48 mm (1.2 inch) nets with 42 warp threads can be produced. With a space u of neighbouring warp threads of 50.8 mm (2 inch), for the standard width of 123 cm the number of warp threads is even smaller, for example 26. As an advantage a lower final weight of the produced net can be achieved with equal strength of the threads used. Conversely, thicker threads than usual can be used, thereby facilitating the production. The strength of the used threads can be set so as to achieve the same final weight as with the conventional machine with a reduced number of warp threads. Due to the fact that thicker threads are used the breakage risk of the threads during the production is lowered. Accordingly, it is no longer required to interrupt the production due to thread breakage. As a result the throughput can be increased and the production costs can be lowered. The threads may have a thickness or rather strength greater than 90 μm or 100 μm.

Figure 5:
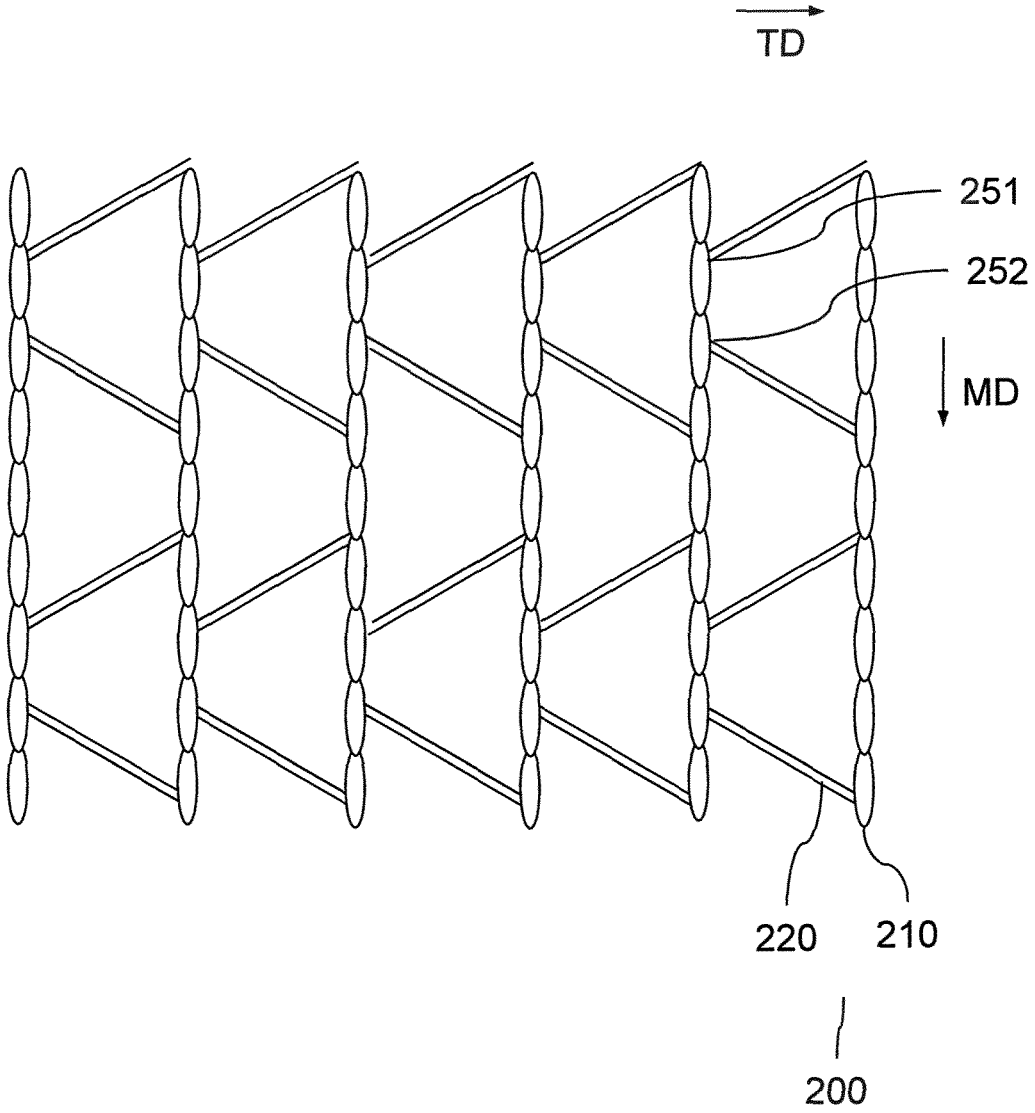
FIG. 5 shows a net according to a further embodiment.

FIG. 5 shows another embodiment of a net. Differing from the configuration of the net depicted in FIG. 4, the entry point 251 and the exit point 252 of the weft thread into and out of the warp thread are offset to each other in machine direction. For example, the weft thread 220 can again be guided along the TD direction only after a certain number of, e.g. three or four or more, loops in order to form the zigzag pattern. This can be achieved by a corresponding control of the movement of the second needle bar 160, for instance. As an example, the second needle bar 160 can again move along the transversal direction only after some time. Thus the weight of the net can further be reduced und finally the strength of the thread can be enhanced with constant weight. The upper limit of the space between neighbouring first guide needles should be dimensioned such that the net does not become too coarse meshed in order that the goods to be packed don't drop out.

Figure 6:
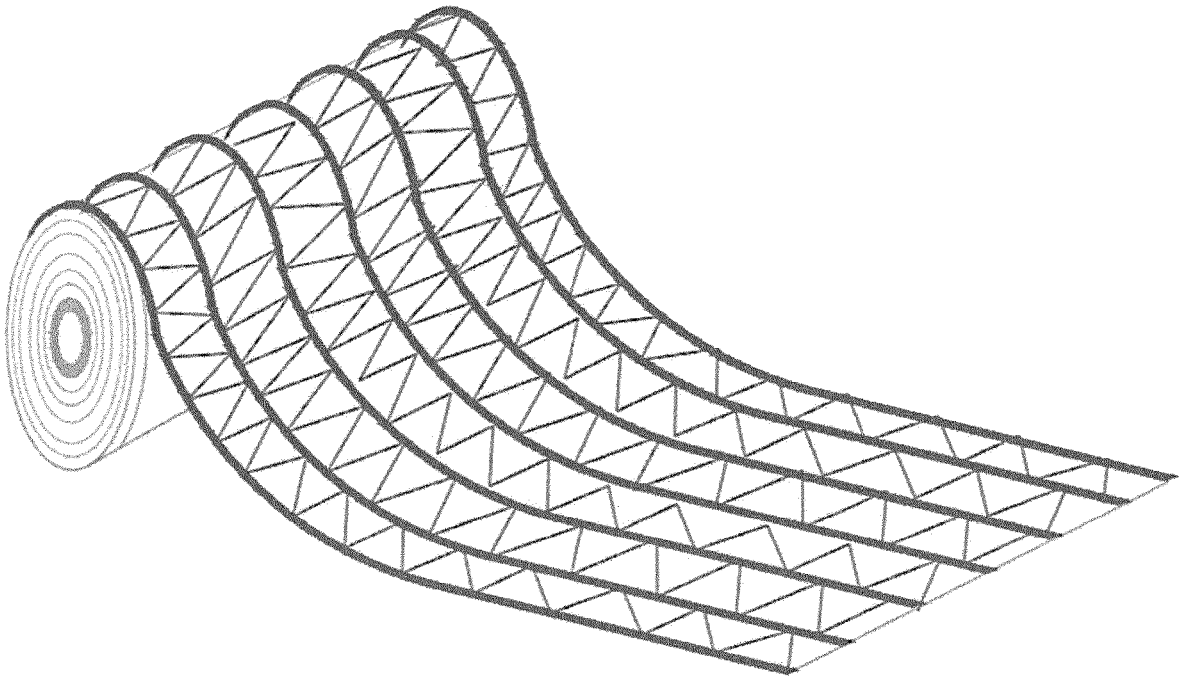
FIG. 6 shows a roll with a net rolled up.

FIG. 6 shows an example of a net rolled up.

Figure 7:
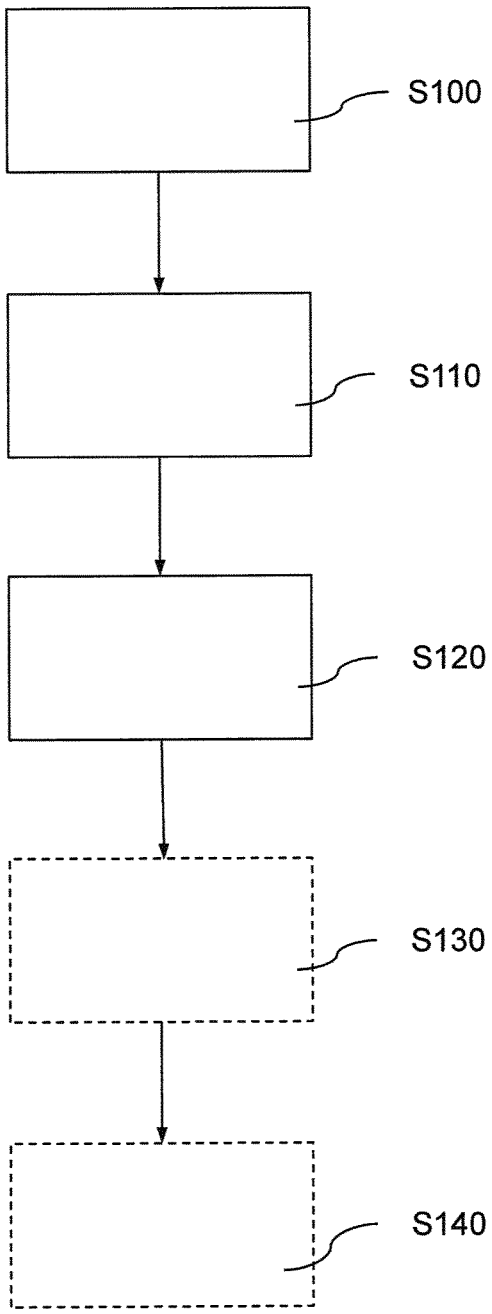
FIG. 7 illustrates a method according to an embodiment.

FIG. 7 illustrates a method for producing a net. As shown, the method includes determining a lower limit of the thickness of a thread the warp threads are to be created of (S100), determining a number of warp threads of the net (S110) such that the weight of the net with warp threads formed by the threads with the lower limit of the thickness does not fall below the weight of a standard net with predetermined width, and determining a space (S120) of the warp threads from the number of warp threads and the predetermined width. If applicable, the method can further include creating warp threads (S130) with the determined space und guiding (S140) weft threads between two respective neighbouring warp threads so that a zigzag pattern is formed.

For instance, the lower limit of the thickness of the thread can be determined such that it is ensured that the thread will not break during the production of the net. The lower limit of the thickness of the thread can, for example, be set to 90 μm or more. The thread may thus have a thickness of at least 90 μm or 100 μm. The predetermined weight of the net may correspond to the standard weight, e.g. 11 g/lm (linear meter). For example, the predetermined width may conform to the standard width of nets (e.g. 123 cm). For instance, the number of warp threads may be smaller than 50, in particular smaller than 45, e.g. 42 or below. According to a further embodiment the number of warp threads may be smaller than 34 or smaller than 30, e.g. from 26 to 29.

The invention claimed is:

1. A Raschel machine, comprising:

a plurality of first guide needles arranged along a first direction for guiding warp threads;

a plurality of second guide needles arranged along the first direction for guiding weft threads; and a plurality of needles arranged along the first direction for creating interlocked loops formed by threads, whereby the warp threads are created, wherein the first guide needles are held by a first needle bar, the second guide needles are held by a second needle bar and the second needle bar is configured to move back and forth between two respective neighbouring first guide needles, wherein the space between neighbouring first guide needles is 50.8 mm (2 inches).

2. The Raschel machine of claim 1, wherein the Raschel machine comprises a single first needle bar and a single second needle bar.

3. The Raschel machine of claim 1, wherein the number of first guide needles is less than 50.

4. The Raschel machine of claim 1, wherein the second needle bar is configured to move back and forth by 50.8 mm (2 inch) in a transversal direction.

5. A net for packing hay, comprising:

a plurality of warp threads arranged along a first direction; and a plurality of weft threads, of which one each runs between two neighbouring warp threads and forms a zigzag pattern, in which the space between neighbouring warp threads is 50.8 mm (2 inch).

6. The net of claim 5, wherein the threads are thin synthetic bands.

7. The net of claim 5, wherein the number of warp threads is less than 50.

8. The net of claim 6, wherein the number of warp threads is less than 35.

9. The net of claim 5, wherein the threads by which the warp threads are formed have a thickness greater than 90 μm.

10. A method of manufacturing a net for packing hay, straw, vegetables, raw cotton or other plant parts, the method comprising:

guiding warp threads via a plurality of first guide needles of a Raschel machine arranged along a first direction;

guiding weft threads via a plurality of second guide needles of the Raschel machine arranged along the first direction; and creating interlocked loops formed by threads, whereby the warp threads are created, via a plurality of needles of the Raschel machine arranged along the first direction, wherein the first guide needles are held by a first needle bar, the second guide needles are held by a second needle bar and the second needle bar is configured to move back and forth between two respective neighbouring first guide needles, wherein the space between neighbouring first guide needles is 50.8 mm (2 inches).

* * * * *